US006223719B1

(12) United States Patent
Yano et al.

(10) Patent No.: US 6,223,719 B1
(45) Date of Patent: May 1, 2001

(54) DEVICE FOR CONTROLLING THE AMOUNT OF THE AIR TAKEN IN BY AN ENGINE

(75) Inventors: Takayuki Yano, Hyogo; Ryoichi Hanazaki; Koji Nishimoto, both of Tokyo, all of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/438,394

(22) Filed: Nov. 12, 1999

(30) Foreign Application Priority Data

May 14, 1999 (JP) ..... 11-134541

(51) Int. Cl.[7] ..... F02D 41/08

(52) U.S. Cl. ..... 123/339.14; 123/339.25; 123/399

(58) Field of Search ..... 123/399, 339.14, 123/339.25

(56) References Cited

U.S. PATENT DOCUMENTS 5,033,431 * 7/1991 Poirier et al. ..... 123/339.25
5,517,966 * 5/1996 Kanazawa et al. ..... 123/399
5,669,351 * 9/1997 Shirai et al. ..... 123/399
5,950,597 * 9/1999 Kamio et al. ..... 123/399
6,006,724 * 12/1999 Takahashi et al. ..... 123/399

FOREIGN PATENT DOCUMENTS 1-167438 7/1989 (JP) ..... F02D/41/06

* cited by examiner

*Primary Examiner*—Erick Solis
(74) *Attorney, Agent, or Firm*—Sughrue, Mion, Zinn, Macpeak & Seas, PLLC

(57) ABSTRACT

A device for controlling the amount of the air taken in by an engine, for improving the starting performance of when the accelerator pedal is depressed from the idling state. The device comprises a throttle control means 10A for operating a target throttle opening degree θo of a throttle valve 6 based on said throttle opening degree θ, an accelerator opening degree α and an idle signal D, and a throttle actuator 7 for opening and closing said throttle valve so that said throttle opening degree comes into agreement with said target throttle opening degree, wherein said throttle control means includes a means 11 for operating a first target throttle opening degree θo1 based on said accelerator opening degree, a means 12 for operating a second target throttle opening degree θo2 based on the idle signal, and a means 13 for operating a target throttle opening degree θo by adding up the first and second target throttle opening degrees together.

5 Claims, 5 Drawing Sheets

DEVICE FOR CONTROLLING THE AMOUNT OF THE AIR TAKEN IN BY AN ENGINE

BACKGROUND OF THE INVENTION

1. Field of the Invention

The present invention relates to a device for controlling the amount of the air taken in by an engine by electrically controlling the throttle valve through a throttle actuator. More particularly, the invention relates to a device for controlling the amount of the air taken in by an engine, for improving the starting performance of when the accelerator pedal is depressed from the idling state.

2. Prior Art

There has heretofore been known a device for controlling the amount of the air taken in by the engine by controlling the throttle valve through a throttle actuator as disclosed in, for example, Japanese Patent Laid-Open No. 1-167438.

The conventional device for controlling the amount of the air taken in by the engine will be described below with reference to the drawings.

FIG. 6 is a block diagram schematically illustrating the constitution of the conventional device for controlling the amount of the air taken in by the engine, and wherein an accelerator pedal 1 operated by a driver is provided with an accelerator opening degree detection means 2 and an idle detection means 3.

The accelerator opening degree detection means 2 detects the opening degree of the accelerator pedal 1 as an accelerator opening degree $\alpha$.

The idle detection means 3 detects an idle signal D that corresponds to the fully closed position of the accelerator pedal 1.

The engine 4 is provided with an intake pipe 5 which includes a throttle valve 6 for adjusting the amount of the air Qa taken in by the engine 4.

The throttle valve 6 is driven by a throttle actuator 7. Further, the throttle valve 6 is provided with a throttle opening degree detection means 8 for detecting the opening degree of the throttle valve 6 as a throttle opening degree $\theta$.

A throttle control means 10 comprising a microcomputer operates a target throttle opening degree $\theta o$ based on the throttle opening degree $\theta$, accelerator opening degree $\alpha$ and idle signal D.

The throttle control means 10 receives not only the throttle opening degree $\theta$ but also the data from various other kinds of sensors (not shown) that detect the operation conditions of the engine 4, and operates the target throttle opening degree $\theta o$.

In this case, the throttle control means 10 produces, as a final target throttle opening degree $\theta o$, either a target throttle opening degree corresponding to the accelerator opening degree $\alpha$ or the target throttle opening degree at the time of ISC feedback corresponding to the idle signal D whichever is larger.

The throttle actuator 7 is driven by the throttle control means 10 and opens or closes the throttle valve 6 so that the throttle opening degree $\theta$ comes into agreement the target throttle opening degree $\theta o$.

Thus, the throttle valve 6 is adjusted to the target throttle opening degree $\theta o$ permitting the air to be taken in by a required amount Qa by the engine 4.

That is, during the normal operation, the intake air amount Qa is adjusted by a target throttle opening degree $\theta o$ that corresponds to the accelerator opening degree $\alpha$ and during the idling operation (during the ISC feedback operation), the intake air amount Qa is adjusted by a target throttle opening degree $\theta o$ required for maintaining the idling speed.

When the driver depresses the accelerator pedal 1 from the idling state to start the vehicle, however, the throttle valve 6 has already been adjusted to the target throttle opening degree $\theta o$ for idling. In practice, therefore, the accelerator pedal is ineffectively depressed until the target throttle opening degree corresponding to the accelerator opening degree $\alpha$ (depressed amount) exceeds the throttle opening degree of during the idling, and it is not allowed to start the vehicle.

This is because in the conventional device, when the target throttle opening degree corresponding to the accelerator opening degree $\alpha$ becomes greater than the throttle opening degree of during the idling as a result of depressing the accelerator pedal 1, the throttle valve 6 is controlled being switched over to the target throttle opening degree $\theta o$ that corresponds to the accelerator opening degree $\alpha$.

According to the conventional device for controlling the amount of the air taken in by the engine as described above, the amount of depressing the accelerator pedal is not reflected by the throttle opening degree $\theta$ unless the target throttle opening degree $\theta o$ of when the accelerator pedal 1 is depressed reaches the throttle opening degree of during the idling, leaving a problem in that the driver feels a delay in the response after having depressed the accelerator pedal.

SUMMARY OF THE INVENTION

The present invention was accomplished in order to solve the above-mentioned problem, and its object is to provide a device for controlling the amount of the air taken in by an engine improving the starting performance of when the accelerator pedal is depressed from the idling state.

A device for controlling the amount of the air taken in by an engine according to the present invention comprises:

a throttle valve provided in the intake pipe of the engine for adjusting the amount of the air taken in by said engine;

a throttle opening degree detection means for detecting the opening degree of said throttle valve as a throttle opening degree;

an accelerator opening degree detection means for detecting the opening degree of the accelerator pedal as an accelerator opening degree;

an idle detection means for producing an idle signal that corresponds to the fully closed position of said accelerator pedal;

a throttle control means for opening a target throttle opening degree of said throttle valve based on said throttle opening degree, said accelerator opening degree and said idle signal; and a throttle actuator for opening and closing said throttle valve so that said throttle opening degree comes into agreement with said target throttle opening degree;

wherein said throttle control means includes:

a first opening degree operation means for operating a first target throttle opening degree based on said accelerator opening degree;

a second opening degree operation means for operating a second target throttle opening degree based on said idle signal; and a target throttle opening degree operation means for operating said target throttle opening degree by adding up said first and second target throttle opening degrees together.

The present invention is further concerned with a device for controlling the amount of the air taken in by an engine, wherein the target throttle opening degree operation means includes a proportional correction means for operating a proportional correction value for the first target throttle opening degree and adds the proportional correction value to the second target throttle opening degree to obtain the target throttle opening degree, and the proportional correction means so operates the proportional correction value that the fully opened position in the accelerator opening degree corresponds to the fully opened position in the throttle opening degree.

The present invention is further concerned with a device for controlling the amount of the air taken in by an engine, wherein the proportional correction means operates the proportional correction value θoc1 by using the operation range W θ of the throttle opening degree, the second target throttle opening degree θo2, the accelerator opening degree α and the operation range W α of the accelerator opening degree in compliance with the following formula, $$\theta oc1=(W\theta-\theta o2)\times\alpha/W\alpha$$

The present invention is further concerned with a device for controlling the amount of the air taken in by an engine, wherein the throttle control means includes a learning means which learns the target throttle opening degree in response to the idle signal, and the target throttle opening degree operation means sets the first target throttle opening degree corresponding to the accelerator opening degree of smaller than a predetermined opening degree to substantially zero in response to said idle signal.

The present invention is further concerned with a device for controlling the amount of the air taken in by an engine, wherein the predetermined opening degree is set to correspond to an upper limit value in the accelerator opening degree at which the idle detection means forms the idle signal.

DETAILED DESCRIPTION OF THE PREFERRED EMBODIMENTS

Embodiment 1

An embodiment 1 of the present invention will now be described with reference to the drawings.

Figure 1:
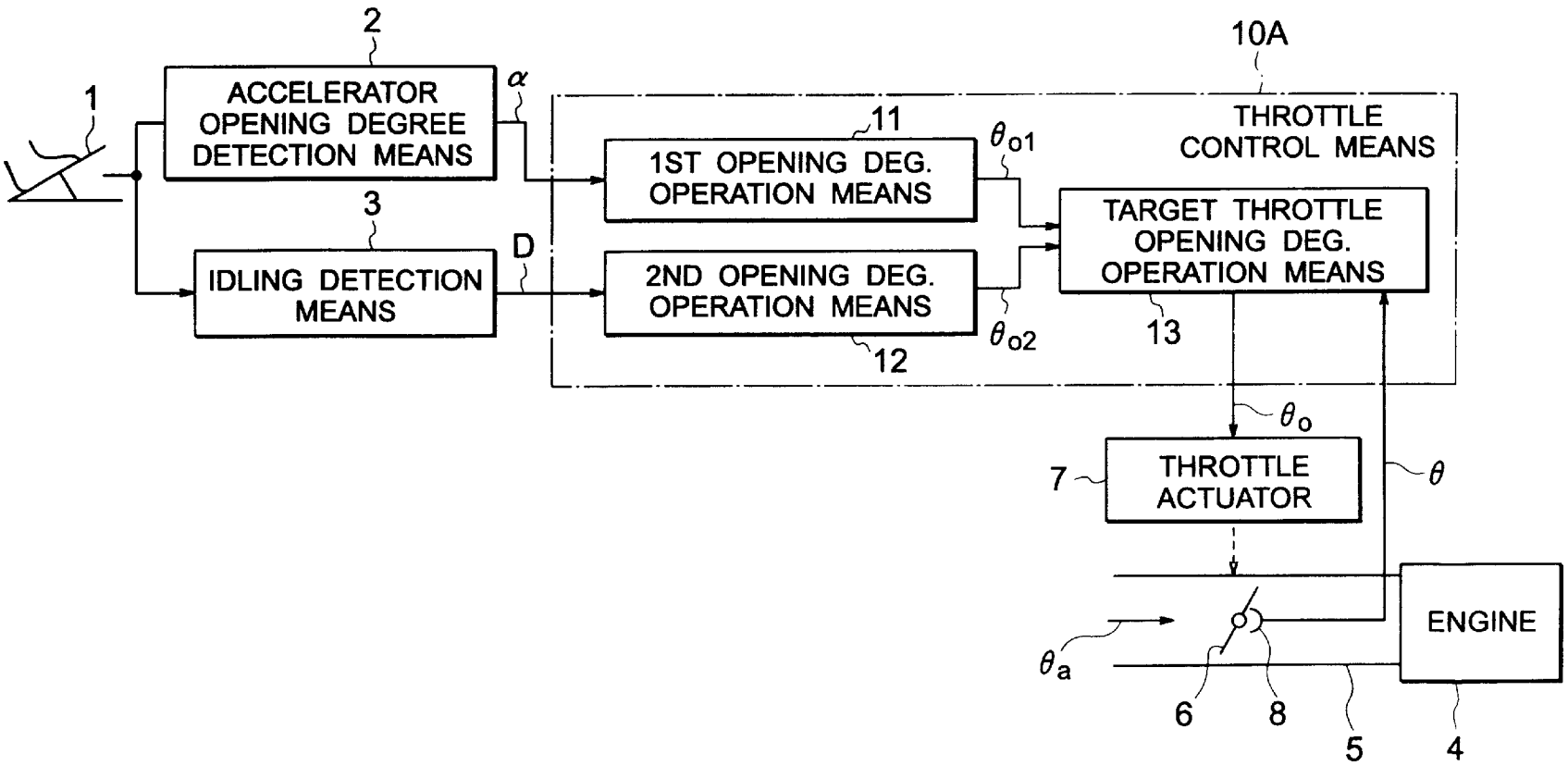
FIG. 1 is a block diagram schematically illustrating the constitution of an embodiment 1 of the present invention.
Figure 6:
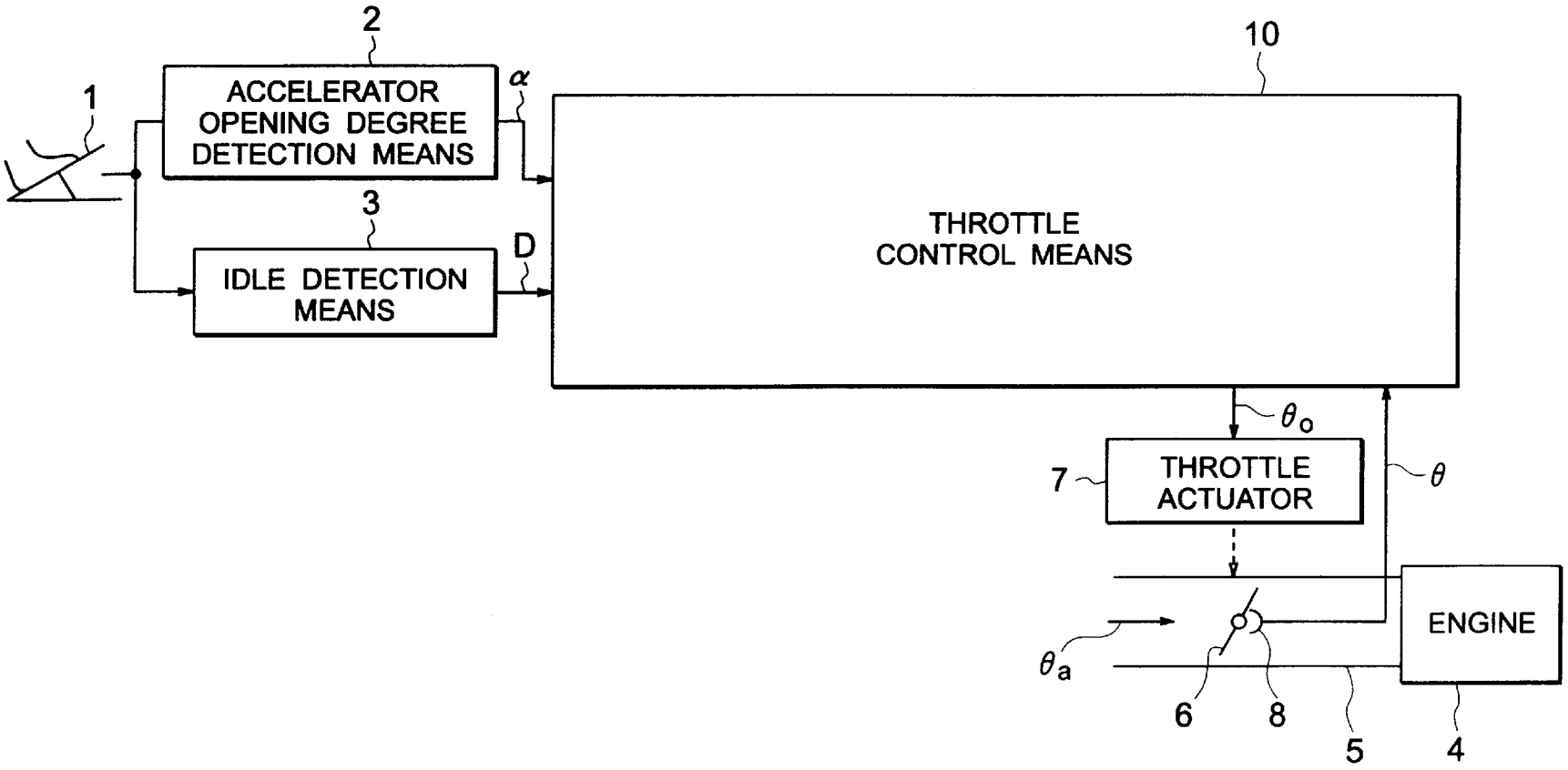
FIG. 6 PRIOR ART
FIG. 6 is a block diagram schematically illustrating the constitution of a conventional device for controlling the amount of the air taken in by the engine.

FIG. 1 is a block diagram schematically illustrating the constitution of the embodiment 1 of the present invention, and wherein the same portions as those described above (FIG. 6) are denoted by the same reference numerals but their description is not repeated.

Here, the throttle control means 10A includes a first opening degree operation means 11 for operating a first target throttle opening degree θo1 depending on the accelerator opening degree α, a second opening degree operation means 12 for operating a second target throttle opening degree θo2 depending on the idle signal D, and a target throttle opening degree operation means 13 for operating a target throttle opening degree θo by adding up the first and second target throttle opening degrees θo1 and θo2 together.

The operation of the embodiment 1 of the invention shown in FIG. 1 will now be concretely described.

First, when the accelerator opening degree α is fully closed to form the idle signal D, the second opening degree operation means 12 produces the second target throttle opening degree θo2 to obtain an engine rotational speed (e.g., about 700 rpm) of idling.

Here, the first target throttle opening degree θo1 which is dependent upon the accelerator opening degree α is almost zero, and the target throttle opening degree operation means 13 controls the throttle opening degree θ by ISC feedback using the second target throttle opening degree θo2 as a target throttle opening degree θo.

When the driver depresses the accelerator pedal 1 to start the vehicle, the first opening degree operation means 11 produces the first target throttle opening degree θo1 depending on the accelerator opening degree α immediately after the accelerator opening degree α has increased.

Here, upon receiving the first target throttle opening degree θo1, the target throttle opening degree operation means 13 produces, as a target throttle opening degree θo, an opening degree obtained by adding the first target throttle opening degree θo1 to the second target throttle opening degree θo2.

Therefore, the target throttle opening degree θo increases irrespective of even right after the start of depression of the accelerator pedal 1 or even in a state where the first target throttle opening degree θo1 is smaller than the second target throttle opening degree θo2, making it possible to readily start the vehicle by increasing the throttle opening degree θ.

In the target throttle opening degree operation means 13 as described above, the first and second target throttle opening degrees θo1 and θo2 are added up together to form the target throttle opening degree θo in order to improve the response of the throttle opening degree θ from the idling.

Therefore, there is no delay in the operation of the throttle valve 6, and the vehicle can be started to match with the driverns feeling permitting a desired amount Qa of air to be taken in by the engine 4.

Embodiment 2

In the above-mentioned embodiment 1, the first target throttle opening degree θo1 was directly added to the second target throttle opening degree θo2 to form the target throttle opening degree θo at the start from the idling. It is, however, also allowable to proportionally correct the first target throttle opening degree θo1 and add it to the second target throttle opening degree θo2.

Described below with reference to the drawings is an embodiment 2 of the present invention in which the first target throttle opening degree θo1 is proportionally corrected and is added to the second target throttle opening degree θo2 of during the idling.

Figure 2:
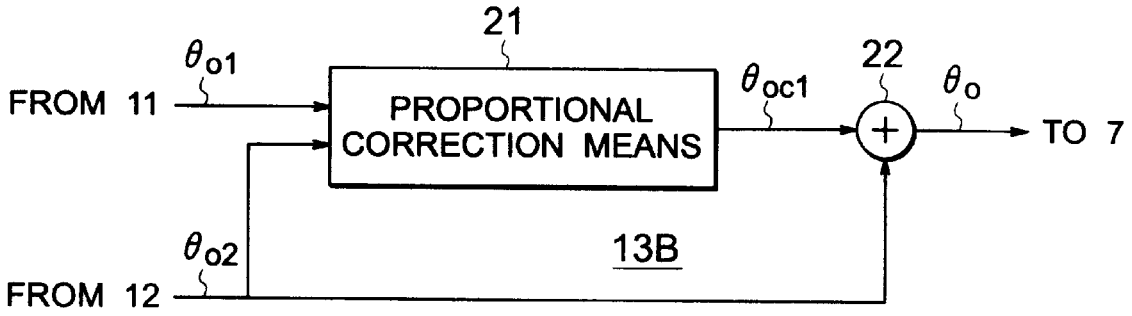
FIG. 2 is a block diagram illustrating a major portion according to an embodiment 2 of the present invention.
Figure 3:
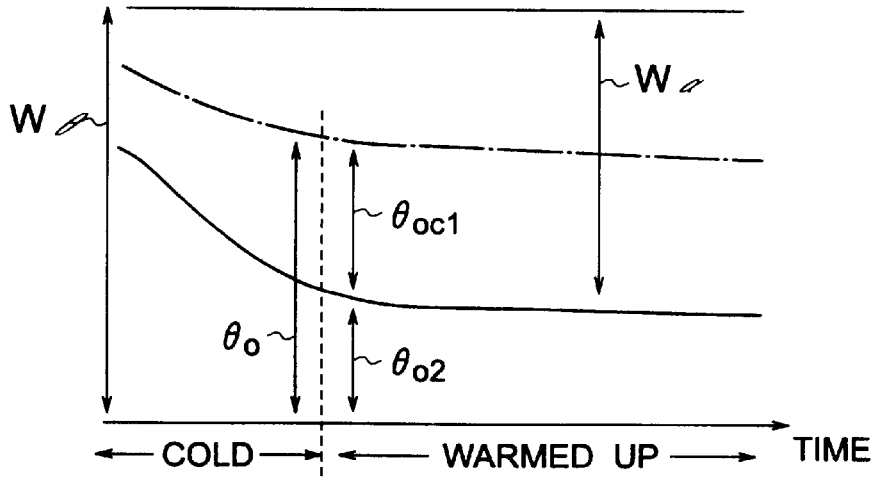
FIG. 3 is a diagram illustrating the addition processing after the proportional correction according to the embodiment 2 of the present invention.

FIG. 2 is a block diagram illustrating the functional constitution of the target throttle opening degree operation means 13B according to the embodiment 2 of the present invention, and FIG. 3 is a diagram illustrating the addition processing after the proportional correction by the embodiment 2 of the invention.

In FIG. 2, the target throttle opening degree operation means 13B includes a proportional correction means 21 for operating a proportional correction value θoc1 of the first target throttle opening degree θo1 and an adder means 22 for adding up the second target throttle opening degree θo2 and the proportional correction value θoc1 together.

The proportional correction means 21 operates the proportional correction value θoc1 so that the fully opened position in the accelerator opening degree α corresponds to the fully opened position in the throttle opening degree θ.

Concretely speaking, the proportional correction value θoc1 is operated by using the operation range Wθ of the throttle opening degree θ and the operation range Wα of the accelerator opening degree α in compliance with the following formula (1), $$\theta oc1=(W\theta-\theta o2)\times\alpha/W\alpha \quad (1)$$

From the above formula (1), there can be maintained a proportional relationship between the operation range Wα of the accelerator opening degree α and the throttle operation range that remains after the second target throttle opening degree θo2 is subtracted from the fully opened position in the throttle opening degree θ irrespective of a change in the second target throttle opening degree θo2 during the idling.

As shown in FIG. 3, for example, the second target throttle opening degree θo2 becomes large under the cold state and becomes small under the warmed-up state.

Depending upon the remaining operation range up to the fully opened position of the throttle valve 6, however, the proportional correction value θoc1 of the first target throttle opening degree θo1 is variably set to a value proportional to the depressed amount of the accelerator in compliance with the formula (1).

Therefore, the target throttle opening degree θo obtained by adding up the second target throttle opening degree θo2 and the proportional correction value θoc1 together, is set as represented by a dot-dash chain line, and the throttle opening degree θ can be controlled maintaining a feeling proportional to the accelerator opening degree α.

That is, when the accelerator opening degree α is brought to the fully opened state, the throttle opening degree θ is brought to the fully opened state, too, correctly reflecting the driver's feeling.

Embodiment 3

In the above-mentioned embodiment 1, no consideration was given to the correction leaning value for controlling the ISC feedback during the idling. In order to prevent incorrect learning during the ISC feedback control that may stem from when the driver leaves his foot put on the accelerator pedal 1, the first target throttle opening degree θo1 corresponding to the accelerator opening degree α smaller than a predetermined opening degree may be set to be substantially zero (invalidated) during the idling.

In order to absorb dispersion in the peripheral structure of the throttle valve 6 and in the control system, the throttle control means 10A stores the offset component in the throttle opening degree θ as a learning value and corrects the control operation at the time of ISC feedback.

In the case of the device having a learning function, when the first target throttle opening degree θo1 dependent upon the accelerator opening degree α is added during the idling, the first target throttle opening degree θo1 is added to the second target throttle opening degree θo2 for maintaining the idling rotational speed if the driver puts his foot on the accelerator pedal 1 even to a light degree.

In this case, the accelerator opening degree α remains very small and the idle signal D is continuously formed to continue the ISC feedback control.

In this state, when the target throttle opening degree θo becomes larger than the second target throttle opening degree θo2 for maintaining the idling speed due to the above-mentioned addition processing, the throttle opening degree θ is controlled by feedback toward the suppress side to maintain the rotational speed of the engine of during the idling.

The throttle opening degree θ thus suppressed is learned as an offset component, and is used as a correction learning value for the ISC feedback control of the next time so as to be reflected on the second target throttle opening degree θo2.

When the driver keeps his foot away from the accelerator pedal 1 in the next idling operation, the target throttle opening degree θo is operated based on the second target throttle opening degree θo2 on which the correction learning value is reflected. Therefore, the engine rotational speed is suppressed to an excess degree despite the accelerator opening degree α is in the fully closed state.

When the correction learning value is incorrectly learned as described above, the engine rotational speed may fall to come into a stall in the ISC feedback control operation of the next time.

It is therefore desired to prevent the correction learning value from being incorrectly learned during the ISC feedback control operation.

Described below with reference to the drawings is an embodiment 3 of the present invention in which the first target throttle opening degree θo1 corresponding to the accelerator opening degree α of smaller than a predetermined opening degree is set to substantially zero during the idling.

Figure 4:
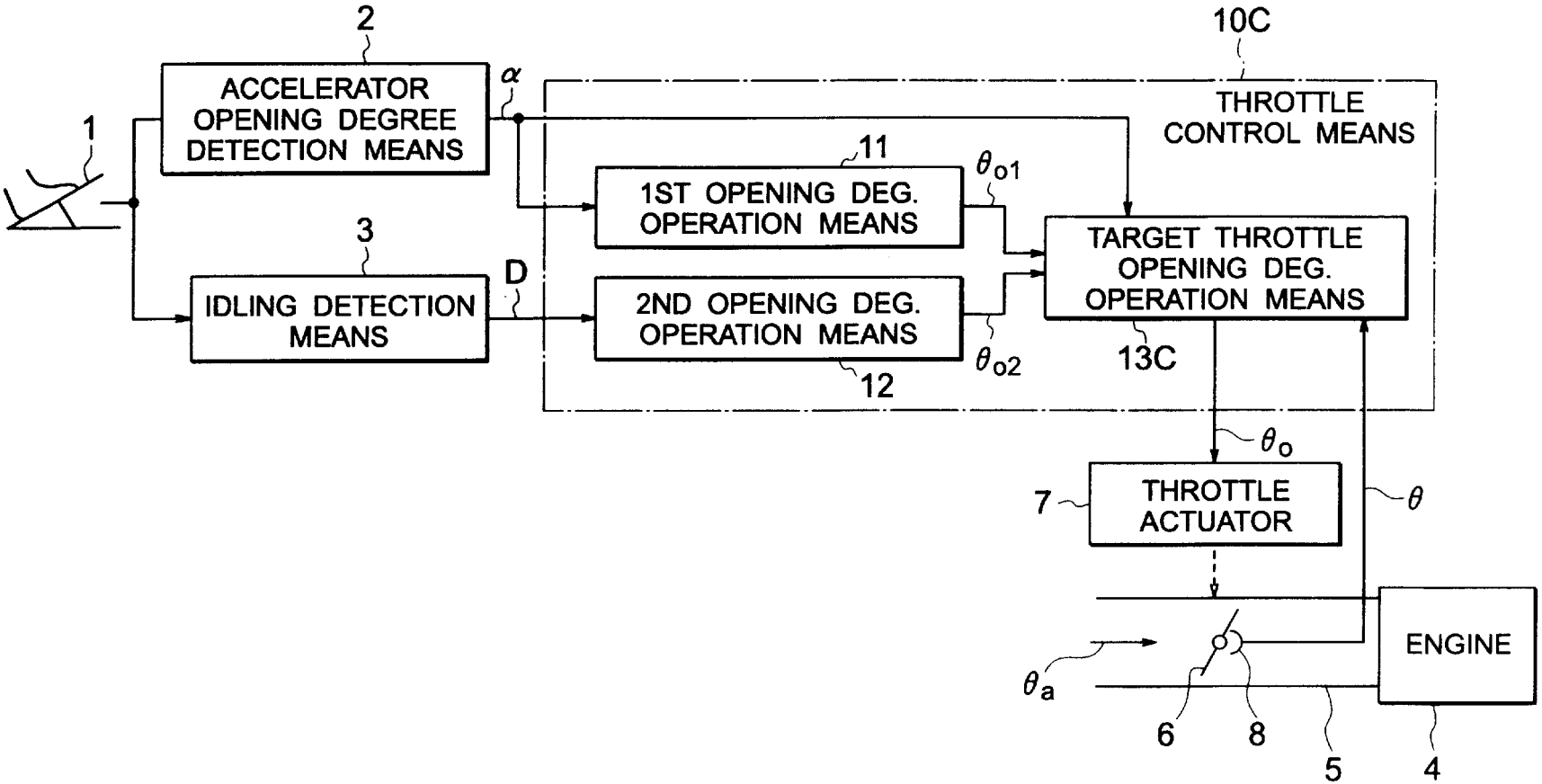
FIG. 4 is a block diagram schematically illustrating the constitution of an embodiment 3 of the present invention.

FIG. 4 is a block diagram schematically illustrating the constitution of the embodiment 3 of the present invention, and wherein the same portions as those described above (see FIG. 1) are denoted by the same reference numerals but their description is not repeated.

In this case, the target throttle opening degree operation means 13C in the throttle control means 10C has a learning means (not shown) for learning the target throttle opening degree θ in response to the idle signal D.

The target throttle opening degree operation means 13C receives the accelerator opening degree α and sets the first target throttle opening degree θo1 corresponding to the accelerator opening degree α of smaller than a predetermined opening degree to substantially zero in response to the idle signal D.

Figure 5:
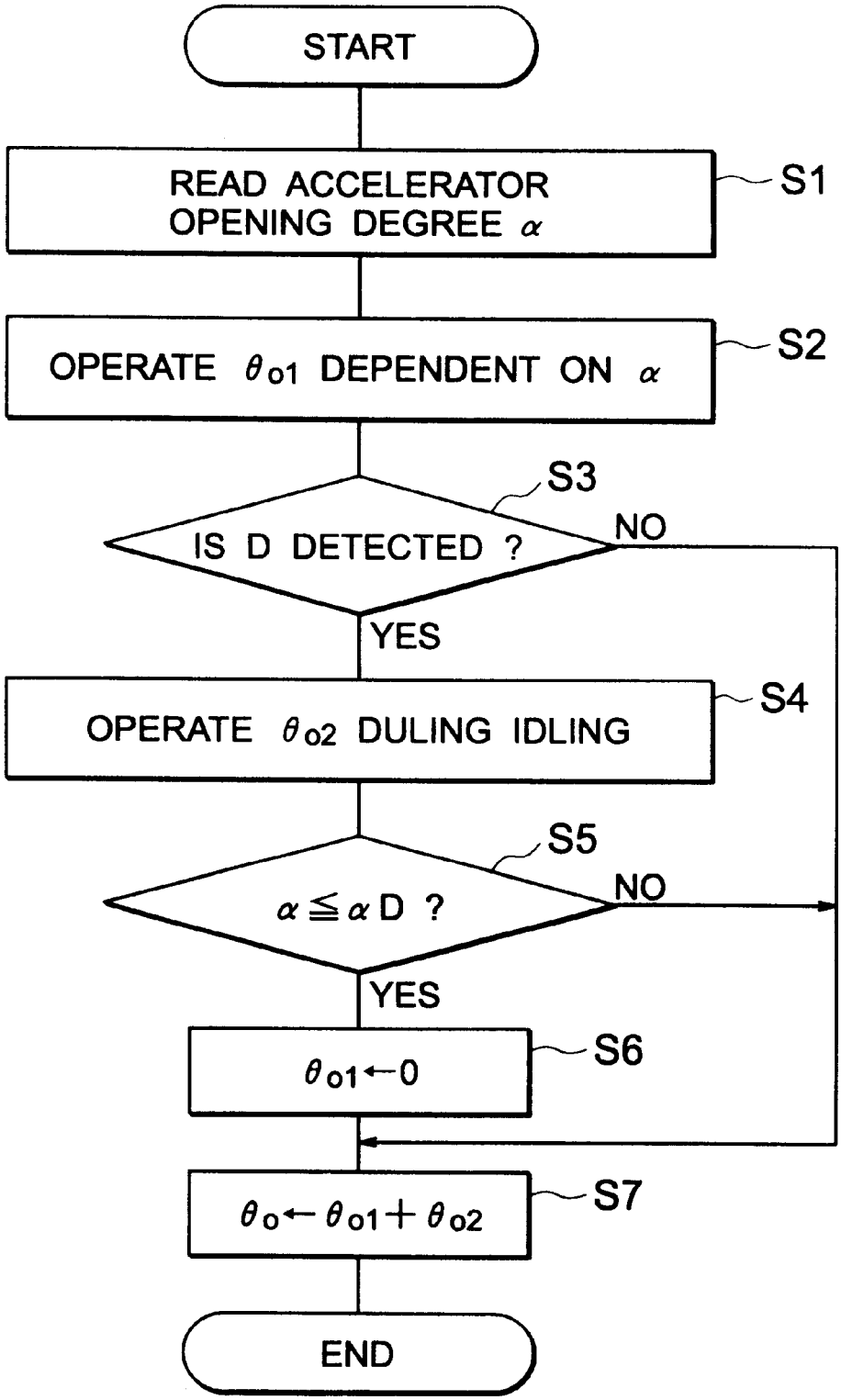
FIG. 5 is a flow chart illustrating the processing operation according to the embodiment 3 of the present invention.

FIG. 5 is a flow chart illustrating the processing operation according to the embodiment 3 of the present invention.

In FIG. 5, the steps S1 to S4 and S7 are processing operations similar to those of the above-mentioned embodiment 1, and the steps S5 and S6 correspond to the processing operation of the embodiment 3 of the present invention.

The first opening degree operation means 11 in the throttle control means 10C reads the accelerator opening degree α (step S1) and operates the first target throttle opening degree θo1 corresponding to the accelerator opening degree α (step S2).

Then, the first opening degree operation means 12 in the throttle control means 10C judges whether the idle signal D is detected or not (step S3). When it is judged that no idle signal D is detected (i.e., NO), the routine readily proceeds to a step S7 (described later).

When it is judged at the step S3 that the idle signal D is detected (i.e., YES), the second opening degree operation means 12 operates the second target throttle opening degree θo2 of during the idling (step S4).

Next, the target throttle opening degree operation means 13C in the throttle control means 10C judges whether the accelerator opening degree α is smaller than a predetermined opening degree ΓD or not (step S5). When it is so judged that $\alpha \leqq \alpha D$ (i.e., YES), the first target throttle opening degree θo1 is set to zero (cleared to 0), and the routine proceeds to a step S7.

When it is judged at a step S5 that $\alpha > \alpha D$ (i.e., NO), the routine proceeds to a step S7 without executing the step S6.

The predetermined opening degree αD is set to correspond to an upper limit in the accelerator opening degree in which the idle detection means 3 forms the idle signal D.

At the step S7, the target throttle opening degree operation means 13C operates, as a target throttle opening degree θo, a value obtained by adding up the first and second target throttle opening degrees θo1 and θo2 together to end the processing routine of FIG. 5.

When the first target throttle opening degree θo1 is cleared to 0 at the step S6 during the idling operation, the second target throttle opening degree θo2 is directly set as the target throttle opening degree θo.

Even when the driver leaves his foot put on the accelerator pedal 1 and the accelerator opening degree α finely varies, the first target throttle opening degree θo1 is set to zero provided the accelerator opening degree α is smaller than the predetermined opening degree αD owing to the ISC feedback control operation during the idling. Therefore, the correction learning value is not incorrectly learned during the idling, and a stable idling rotational speed is maintained.

What is claimed is:

1. A device for controlling the amount of the air taken in by an engine comprising:

a throttle valve provided in the intake pipe of the engine for adjusting the amount of the air taken in by said engine;

a throttle opening degree detection means for detecting the opening degree of said throttle valve as a throttle opening degree;

an accelerator opening degree detection means for detecting the opening degree of the accelerator pedal as an accelerator opening degree;

an idle detection means for producing an idle signal that corresponds to the fully closed position of said accelerator pedal;

a throttle control means for operating a target throttle opening degree of said throttle valve based on said throttle opening degree, said accelerator opening degree and said idle signal; and a throttle actuator for opening and closing said throttle valve so that said throttle opening degree comes into agreement with said target throttle opening degree;

wherein said throttle control means includes:

a first opening degree operation means for operating a first target throttle opening degree based on said accelerator opening degree;

a second opening degree operation means for operating a second target throttle opening degree based on said idle signal; and a target throttle opening degree operation means for operating said target throttle opening degree by adding up said first and second target throttle opening degrees together.

2. A device for controlling the amount of the air taken in by an engine according to claim 1, wherein said target throttle opening degree operation means includes a proportional correction means for operating a proportional correction value for said first target throttle opening degree and adds said proportional correction value to said second target throttle opening degree to obtain said target throttle opening degree, and said proportional correction means so operates said proportional correction value that the fully opened position in said accelerator opening degree corresponds to the fully opened position in said throttle opening degree.

3. A device for controlling the amount of the air taken in by an engine according to claim 2, wherein said proportional correction means operates said proportional correction value θoc1 by using the operation range Wθ of said throttle opening degree, said second target throttle opening degree θo2, said accelerator opening degree α and the operation range Wα of said accelerator opening degree in compliance with the following formula, $$\theta oc\mathbf{1} = (W\theta - \theta o\mathbf{2}) \times \alpha / W\alpha$$

4. A device for controlling the amount of the air taken in by an engine according to claim 1, wherein said throttle control means includes a learning means which learns said target throttle opening degree in response to said idle signal, and said target throttle opening degree operation means sets said first target throttle opening degree corresponding to the accelerator opening degree of smaller than a predetermined opening degree to substantially zero in response to said idle signal.

5. A device for controlling the amount of the air taken in by an engine according to claim 4, wherein said predetermined opening degree is set to correspond to an upper limit value in the accelerator opening degree at which the idle detection means forms the idle signal.

* * * * *